US005342012A

United States Patent [19]

Ryu

[11] Patent Number: 5,342,012

[45] Date of Patent: Aug. 30, 1994

[54] HEIGHT ADJUSTING MECHANISM FOR SWIVEL CHAIR

[76] Inventor: Chang-Keun Ryu, No. 1-168, Kan Sok-3 dong, Nam Dong-ku, Inchon, Rep. of Korea

[21] Appl. No.: 8,664

[22] Filed: Jan. 25, 1993

[30] Foreign Application Priority Data

Jan. 28, 1992 [KR] Rep. of Korea ..... 1992-1231
Jun. 5, 1992 [KR] Rep. of Korea ..... 1992-9923
Dec. 29, 1992 [KR] Rep. of Korea ..... 1992-27099

[51] Int. Cl.[5] ..... A47C 3/00
[52] U.S. Cl. ..... 248/406.2; 248/417
[58] Field of Search ..... 248/406.2, 406.1, 407, 248/409, 415, 417–418, 223.1, 561; 297/344.12, 344.18, 344.21; 24/545, 563, 652, 654, 656, 683, 686

[56] References Cited

U.S. PATENT DOCUMENTS 3,991,965 11/1976 Westover ..... 248/406.2
4,087,070 5/1978 Hancock ..... 248/406.1
4,234,152 11/1980 Browse ..... 248/406.2 X
4,324,382 4/1982 Beukema et al. ..... 248/406.2
4,394,001 7/1983 Wisniewski ..... 248/406.2 X
4,494,721 1/1985 Trinkel et al. ..... 248/406.2
4,598,892 7/1986 Franckowiak et al. ..... 248/406.2
4,640,484 2/1987 Lamond et al. ..... 248/407
4,709,894 12/1987 Knoblock et al. ..... 248/417 X
4,828,212 5/1989 Dicks ..... 248/406.2
5,201,799 4/1993 Johnson ..... 24/563 X

FOREIGN PATENT DOCUMENTS 54-19111 2/1979 Japan .
91-5145 7/1991 Rep. of Korea .

*Primary Examiner*—Karen J. Chotkowski
*Attorney, Agent, or Firm*—Ladas & Parry

[57] ABSTRACT

A height adjusting mechanism for a swivel chair prevents a tightening phenomenon and involuntary adjustment of the position. The mechanism includes a supporting pillar pipe and a cylinder pipe coupled so that they can freely extend and contract relative to each other. A clutch unit is provided for connecting and disconnecting a height adjusting power transmission. The clutch unit includes a nut clutch and a clutch plate coupled or released to one another and a chamber of predetermined width is defined within the nut clutch. In the chamber, a rubber O-ring is provided for holding the nut clutch.

10 Claims, 7 Drawing Sheets

HEIGHT ADJUSTING MECHANISM FOR SWIVEL CHAIR

BACKGROUND OF THE INVENTION

The present invention relates to a height adjusting mechanism for swivel chair, and more particularly to a height adjusting mechanism for swivel chair in which a tightening phenomenon is avoided and an adjusted position is not changed, and an assembling is possible by a simple insertion fitting manner by utilizing a clip so that a manufacturing property and productivity can be improved.

A lift of swivel chair is an adjusting mechanism for appropriately adjusting the height of a seating plate in accordance with a body condition of a user, and various kinds of such adjusting mechanisms have been developed and used heretofore. For instance, a telescopic type and a screw type are mainly widely used, and these mechanisms are made in general to adjust a desired chair height by additionally providing to a column which is uprightly provided between a seating plate of the chair and legs whereby providing a height of the seating plate. Such column usually comprises a supporting pillar pipe and a cylinder pipe which bears the seating plate and is coupled by insertion fitting manner so as to be freely lifted and dropped within the supporting pillar pipe, and a chair height adjusting mechanism is additionally provided within this supporting pillar adjusting body so that a desired adjusting operation is obtained. The adjusting mechanism provided as these comprise some mechanical elements consisting of a screw, a clutch function for connecting or disconnecting a power transmission and a spring for returning this clutch to an original state so that the height adjustment is obtained. More particularly, it is constructed so as to connect or disconnect the lifting or dropping force by the clutch function by utilizing a difference between the load values where an occupied load is applied or not applied to the seating plate of the chair, and when an occupied load is applied to the chair, the cylinder pipe is dropped down and simultaneously the spring is compressed and a clutch mechanism coupled in screw manner with a screw shaft is released whereby a nut clutch is disconnected from the cylinder pipe whereby becomes to be an idle rotation without transmitting the rotating force of the seating plate to the nut clutch so that the height adjustment of the chair is not made, and on the contrary, in case of a state that a person does not seated on the chair, i.e., in case when a load is excluded, the cylinder pipe which has been dropped down by the returning force of the spring is returned to an original state and becomes to couple the clutch mechanism, and at the same time, the nut clutch and the cylinder pipe are made to be integral whereby a rotating force of the seating plate is transmitted to the nut clutch through the cylinder pipe, and the transmitted rotating force as these rotates the nut clutch, and the nut clutch is moved to up or down ward along with the screw so that a desired chair height adjustment can be obtained. For instance, a Japanese utility model official publication No. Sho-55-34846 and a U.S. Pat. No. 3,991,965 can be cited.

However, these adjusting mechanisms lift up the cylinder pipe by a returning force of the spring as in the above description in a state that an occupied load is excluded on the seating plate, and this lifting displacement makes the rotating force of the seating plate to be transmitted through the cylinder pipe when the clutch mechanism is coupled and the seating plate is rotated to right or left direction whereby the nut clutch is lifted up or dropped down to up or down ward along with the screw shaft in response to the rotating direction so that the chair height is made to be adjusted, and at this moment, when the seating plate is further rotated in a state that the nut clutch is reached to a uppermost end or to a lowermost end of the screw shaft due to a carelessness of a user, the nut clutch makes a tightening phenomenon at the uppermost end of the screw shaft and thereby a troublesome to have this to release again is accompanied, and since it is released by applying an instantaneous shock to the nut clutch in a reverse direction of tightening force upon releasing of the nut clutch operated with this tightening force, there has been a problem that it gives a unreasonableness to the mechanical elements and causes a factor of damage.

And, when an occupied load is applied to the chair and the clutch mechanism is released, the nut clutch becomes to be placed to a free state, and at this moment, when a shock or vibration of exterior is applied to the chair, the nut clutch which has been screw-coupled with the screw shaft can not maintain the adjusted current position and the position would be changed little by little whereby the chair height adjusting position is made to be changed, and therefore there has been a defect that the adjusted height is changed at every time changing the chair height adjusting position and seating on the chair and thereby the re-adjusting operation has to be made, in other word, the adjusting state of the chair is not made to be stable. And therefore, in order to solve the problem as described above, a lifting and dropping adjusting mechanism for swivel chair (Korean utility model official publication No. 91-5145) added with a tightening structural elements is developed and used in which a washer is provided at a bottom of a thrust bearing which is interposed between the nut clutch and the spring, a upwardly opened retaining circular groove is defined within an interior of the nut clutch, a rubber O-ring is provided such that a portion comes up to a upper surface of this retaining groove whereby the rubber O-ring is compressed by an expanding force of the spring transmitted through the washer and biting the screw shaft by a tightening force produced upon contracting of its inner diameter so that the nut clutch is fixed not to be so easily changed. This lifting and dropping adjusting mechanism has obtained a little effect for avoiding an alteration of the clutch, but the tightening force of the rubber O-ring is greatly operated unnecessarily, therefore there has been a defect that the lifting and dropping adjustment of the nut clutch upon adjusting the height is not smooth.

And, as described above, since a washer (holding ring) for compressing and expanding the rubber O-ring has to be necessarily provided at upper side of the nut clutch (height adjusting means), the mechanical elements are increased, and since this fixing space of the mechanical elements are necessarily required, there has been a defect that the volume of the device becomes bigger, but also there has been a problem in improving the productivity because expense for materials and assembling process number become more. And, since the compressing and expanding value of the rubber O-ring becomes different in accordance with that the occupied load being applied or not, its tightening force also becomes to have difference a little in accordance with the operation of the occupied load, and the tightening state of the rubber O-ring is released in a state that the occupied load is released whereby the nut clutch is moved little by little from the screw in case when the external force is applied, and such movement has caused a defect to change the adjusted position. And, a release stopping polygonal nut for automobile which suppresses the releasing of nut by interposing a ring which is big in frictional resistance to a nut to be coupled with the screw shaft has been also already widely known.

Therefore, recently the applicant of this application has previously filed an application of a height adjusting mechanism of swivel chair in which the height adjusting function is made to be smooth by a simple construction in which a clutch recess is defined at a central portion of interior of the nut clutch to be screw-coupled to the screw shaft and a rubber ring is inserted to said recess in a structure as described above.

On the other hand, the screw shaft for directly providing a height of the chair among the adjusting mechanism is firmly fixed to a bottom surface such that a movement and rotation are prevented in an axial direction of the screw shaft and an orthogonal direction to the axial direction, and such fixing method is carried out by integrally providing a piercing through bar having a predetermined diameter at an end portion of the screw shaft, this screw shaft's piercing through bar is passed toward exterior through a passing through hole perforated at a bottom center of the supporting pillar pipe, and then its projected piercing through bar and the bottom surface of the supporting pillar pipe are welded at the exterior. However, since this fixing method necessarily requires a welding process, much working time period and many processes are required, and accordingly not only there has been a defect that a manufacturing property as well as mass productivity are worse, but also there has been a nonproductive and uneconomical problem that in case when a part is damaged in partial, i.e., in case when screw tips of the crew shaft are damaged, the supporting pillar pipe itself has to be changed.

OBJECT AND SUMMARY OF THE INVENTION

Therefore, the present invention is made by considering a situation as described above, and it is an object of the present invention to provide a height adjusting mechanism for swivel chair which is simple and effective that a tightening phenomenon of the nut clutch is not produced.

Another object of the present invention is to provide a height adjusting mechanism for swivel chair in which a height adjusting position of the chair is exactly maintained.

A still other object of the present invention is to provide a height adjusting mechanism for swivel chair in which the constituting elements are simplified so that the manufacturing property and a merchandizing property are improved, and simultaneously a repairing of parts is made to be possible.

These objects of the present invention are attained by providing a height adjusting mechanism for swivel chair which is made to use a clutch for adjusting the height of the swivel chair, and this mechanism comprises a cylinder pipe and a supporting pillar pipe which are coupled by an insertion fitting manner so as to be possible to freely extend and contract, and first and second springs, a sleeve, thrust bearing and a clutch unit for connecting and disconnecting a chair height adjusting force transmission within said cylinder pipe. The clutch unit consists of a nut clutch and clutch plate to be coupled to or released from each other, and a vertical portion and a slant portion are provided to a recess defined within the nut clutch of the clutch unit, and an obtuse angular corner for automatically releasing the clutch function by producing a sliding in case when an abnormal exterior force is applied to a portion where this vertical portion and the slant portion are connected, is included. And, a chamber having a predetermined width is defined within an interior of the nut clutch, and a rubber O-ring for holding the nut clutch by biting the screw shaft within this chamber is provided and at the same, the screw shaft is made to be coupled and fixed to the bottom of the supporting pillar pipe by a clip with a simple insertion fitting manner. Accordingly, the tightening phenomenon of the nut clutch is prevented, the adjusting position is stably and firmly fixed and maintained, and a change of parts become possible in partial.

BRIEF DESCRIPTION OF THE DRAWINGS

FIG. 1 is a side view of a swivel chair provided with a height adjusting mechanism of the present invention, FIGS. 2(A), (B) are longitudinal cross sectional views showing an interior structure of the height adjusting mechanism of swivel chair of the present invention, in which

DETAILED DESCRIPTION OF THE PREFERRED EMBODIMENTS

Hereinafter, a preferred embodiment of the present invention will be described in more detail with reference to the accompanying drawings.

Figure 1:
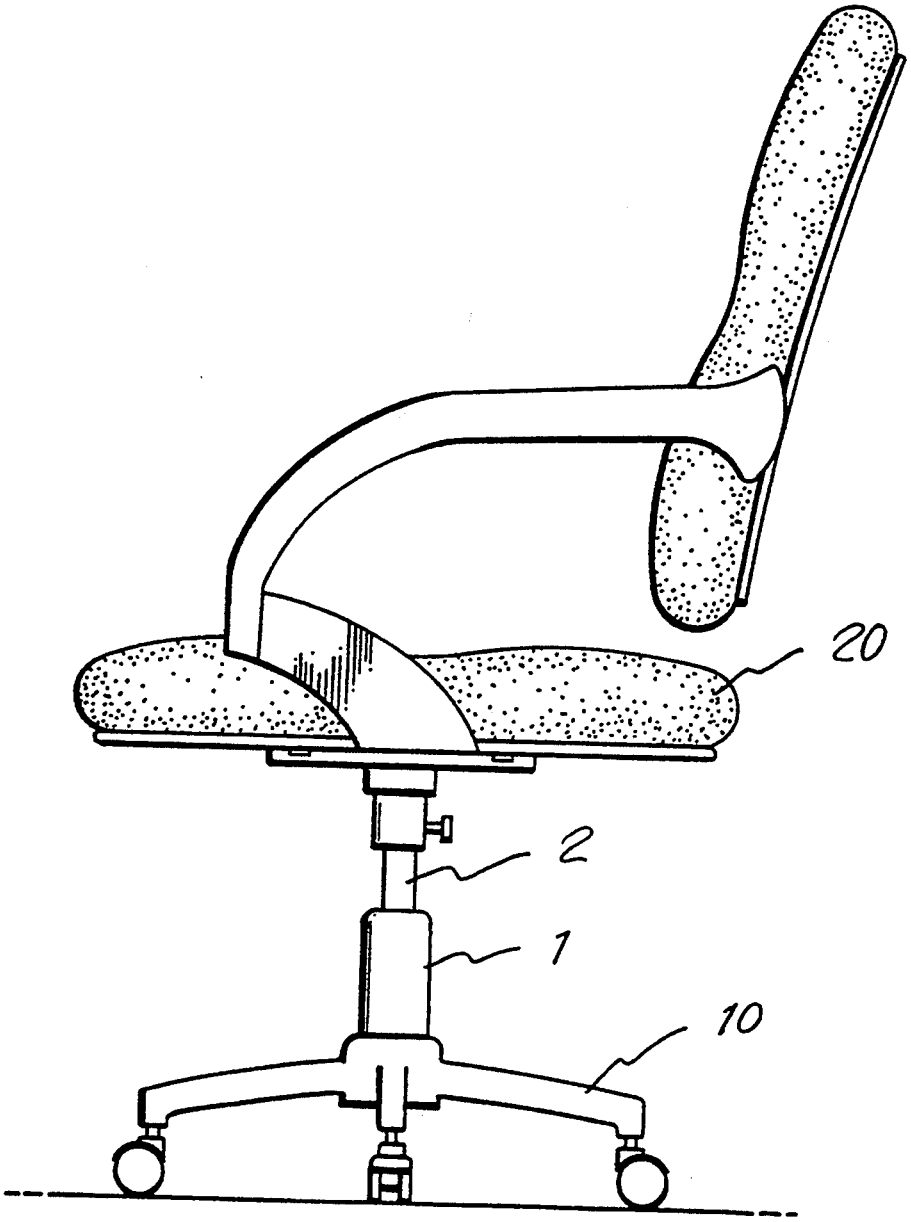

A swivel chair provided with the height adjusting mechanism of the present invention is shown in FIG. 1, and this chair includes legs 10 having three or four legs and a seating plate 20 having a back, and which includes a column for maintaining a distance between these legs and the seating plate.

Figure 2A:
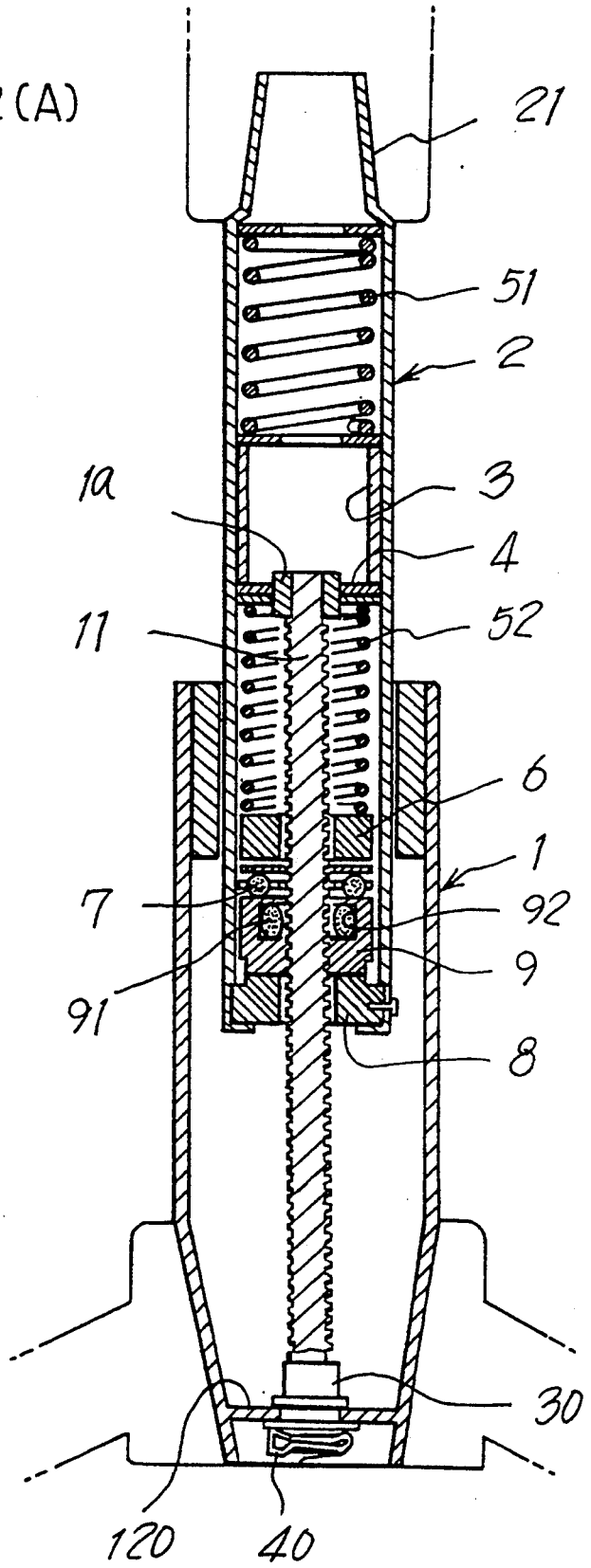
FIG. 2(A) is a longitudinal cross sectional view showing a unoccupied state of the swivel chair.
Figure 2:
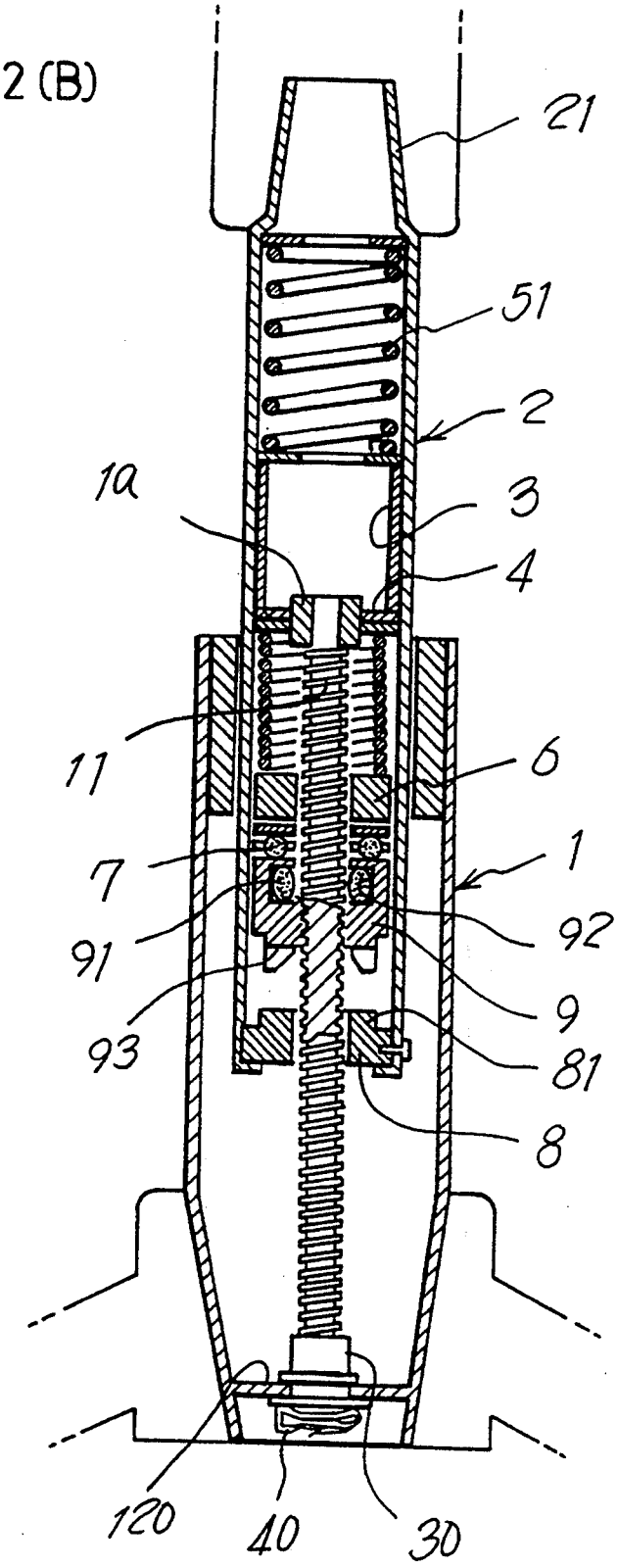
FIG. 2(B) is a longitudinal cross sectional view showing an occupied state of the swivel chair.

FIGS. 2(A),(B) show in detail the structure of a column. The column comprises a supporting pillar pipe 1 and a cylinder pipe 2, their length is freely extended and contracted and thereby a seating height of the seating plate will be provided. An adjusting mechanism is additionally provided to the column of this swivel chair and thereby a desired chair height adjusting operation is obtained.

Explaining this in more detail, that is, a cylinder pipe 2 which is placed with a seating plate 20 by being coupled in an insertion fitting manner to an inserting portion 21 made in a taper form becoming to gradually narrower by going to upward at a top end portion is provided so as to be possible to freely adjust to lift and drop into a supporting pillar pipe 1 which is made in substantially a tube body shape firmly fixed in upright on a top of center of a leg 10; and a first spring 51, a bushing 3, a washer 4 and a second spring 52 are provided in turn from the top within the cylinder pipe 2 provided as above, and a sleeve 6 and roller seat 7 are also provided in turn at a bottom side of this. At this moment, the first spring 51 contained within a top side of the cylinder pipe 2 absorbs an exterior shock whereby executes a buffing operation so that a relieving operation for reducing the shock applied to the joining portions of top and bottom ends of the column in minimum will be made.

And, a nut clutch 9 which may be releasably engaged with a clutch plate 8 integrally fixed at bottom end within the cylinder pipe 2 is provided in a screw-coupling manner to the bottom of the roller seat 7, and a screw shaft 11 is supported by extending between the supporting pillar pipe 1 and the cylinder pipe 2 respectively by utilizing a bush 1*a* at its top end and a flange type bush 30 which will be explained hereafter at its bottom end. Explaining again, the top end of the screw 11 is coupled in an insertion fitting manner so as to be freely rotatable to a bush 1*a* integrally fixed with a washer 4 provided at a middle upper side within the cylinder pipe 2, and its bottom end is firmly fixed to a flange type bush 30 provided at a bottom of the supporting pillar pipe 1. And, a roller seat 7 provided between the sleeve 6 and the nut clutch 9 will provide a slip or slide so as not to receive an interference one another between the sleeve and the nut clutch.

And, the second spring 52 provided between the bush 3 and the sleeve 6 within the cylinder pipe 2 bears the washer 4 provided at upper side within the supporting pillar pipe 1 whereby pushes up a self weight of the seating plate excluded the occupied load and at the same time, it has a suitable upward resiliency for coupling the clutch plate 8 to the nut clutch 9. This spring is contracted when an occupied load is applied to the seating plate of the chair, and returned to an original state when the occupied load is removed, in other words, the spring is extended and the supporting pillar pipe is automatically pushed up whereby it will provide an engaging force of the clutch plate 8 and the nut clutch 9 for adjusting the seating height of the chair which will be explained hereafter.

Figure 3:
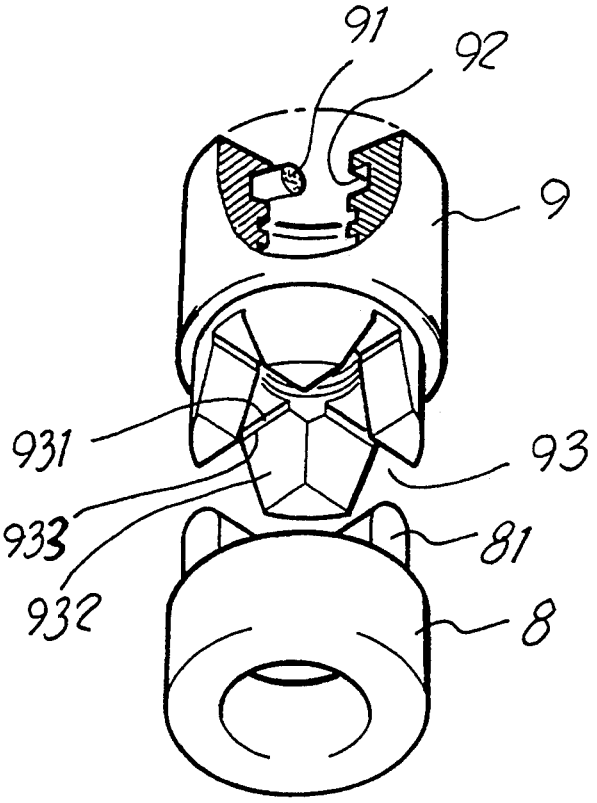
FIG. 3 is a fragmentary perspective view of a nut clutch applied to the height adjusting mechanism of swivel chair of the present invention, FIGS. 4(A), (B) are schematic diagrams showing by developing an engaging portion of the nut clutch and a clutch plate of the clutch means being a major component of the present invention.

A structure of the nut clutch is shown in more detail in FIG. 3. The nut clutch 9 includes a chamber 92 for receiving a rubber O-ring 91 of substantially circular shape in section by defining a cylindrical space of a predetermined magnitude opened to inward at upper side of the interior, i.e., at upper side of internal wall provided with threads. At this moment, the rubber O-ring 91 has a thickness which is to be tightly inserted in forcible insertion fitting manner to the wall within the chamber, and an outer diameter of the rubber O-ring has a diameter which is almost same as that of the wall of the chamber, and an inner diameter has a diameter which is smaller a little than an outer diameter of the screw shaft 11 so that the screw shaft is to be assembled in a forcible insertion fitting manner. At this moment, the rubber O-ring 91 receives the screw shaft 11 with a suitable buffing property whereby deeply receives thread tips of the screw shaft and at the same time, applies a suitable pressure to the thread tips of the screw shaft and thereby a uniform and stable biting force will be provided to the screw shaft.

And, a surface area portion to be loaded with a spring 52, a sleeve 6 and a roller seat 7 is provided on a top surface of the nut clutch 9 whereby it provides a bearing force for bearing these. This bearing force will become to provide a height of the seating plate of the chair.

The nut clutch 9 of the adjusting mechanism constructed as this provides a seating height of the seating plate in accordance with the position that it is stopped at any one position of the screw shaft 11 and at the same time, receives an occupied load, and it is desirable to manufacture the nut clutch by using a material which is excellent in strength as far as possible.

Figure 4A:
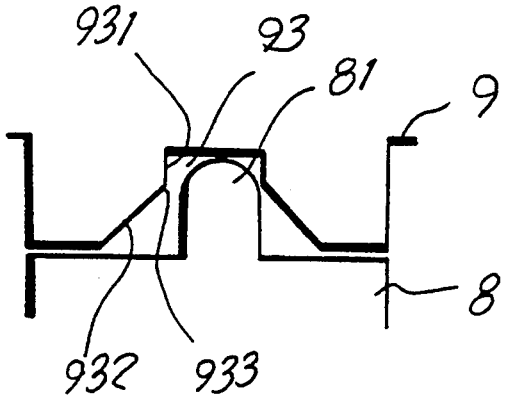

FIGS. 4(A), (B) show in detail in relation to the mutual coupling structure of the clutch plate 8 and the nut clutch 9 which are essential constituting elements of the adjusting mechanism. Namely, at least more than one recesses 93 are included with a pertinent distance interval on the bottom of the nut clutch 9 and vertical portions 931 and slant portions 932 are respectively included to both walls of these recesses 93.

The vertical portion 931 of the recess 93 has a height of approximately $\frac{1}{3}$ of entire height of the recess of the nut clutch, and other remaining $\frac{2}{3}$ is made of a slant portion 932. The recess 93 structured as this provides a receiving space which is to be engaged with a projecting portion 81 projected to upward from top surface of the clutch plate 8 so as to execute a clutch function. Explaining in more particularly, the recess 93 consists of a vertical and slant portions 931,932, and an obtuse angled portion 933 is provided at a point that the vertical and slant portions meet together. This obtuse angled portion 933 is contacted to a pertinent position below the apex point of the projecting portion of semicircular shape in cross section correspondingly provided with said recess on a top surface of the clutch plate 8 whereby it will provide a linear contact having a possibly little frictional coefficient with the projecting portion 81. At this moment, the linear contact produced between the obtuse angled portion 933 and the projecting portion 81 will provide a frictional force less than an abnormal exterior force applied to the nut clutch 9.

Figure 4B:
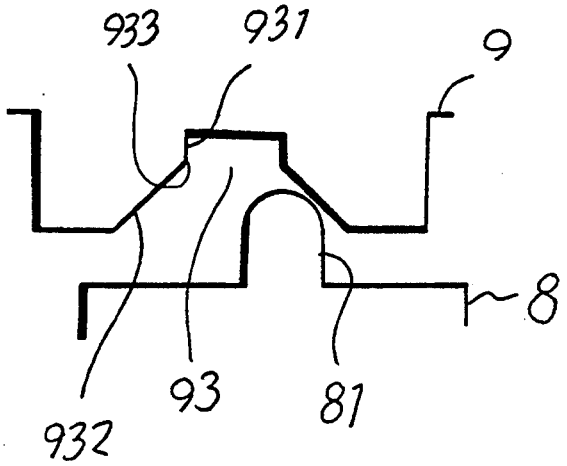

A case of FIG. 4(A) shows a state that the clutch plate 8 and the nut clutch 9 are coupled together thereby providing a braking force to the nut clutch 9. At this time, an occupied load is excluded on the seating plate and the cylinder pipe 2 is lifted up by a returning force to an original state of the spring 51,52, and when the clutch plate 8 integrally fixed within the cylinder pipe and the nut clutch 9 are coupled together and a rotating force is applied to the seating plate, its rotating force is transmitted to the nut clutch through the cylinder pipe and the clutch plate so that desired chair height adjusting operation will be obtained. At this moment, when a rotating force a little bigger than the frictional force produced between the obtuse angled portion 933 within the recess 93 and the projecting portion 81 of the clutch plate 8, the nut clutch 9 slides up along the bent surface of the projecting portion of the clutch plate. This sliding phenomenon makes to push up the nut clutch 9 to upward as shown in FIG. 4(B) by a height provided from the projecting portion of the clutch so that the clutch function is automatically released. The releasing operation of the clutch produced as this is constructed to prevent a unreasonableness to the adjusting mechanism, i.e., to prevent a matter that a tightening phenomenon is produced to a clutch structure by the nut clutch at a uppermost and lowermost ends of the screw shaft 11 by unnecessarily further rotating the chair due to a carelessness of the user. And, the slant portion 932 provided within the recess 93 is desirable to make at an angle of approximately 45 degrees.

Figure 5:
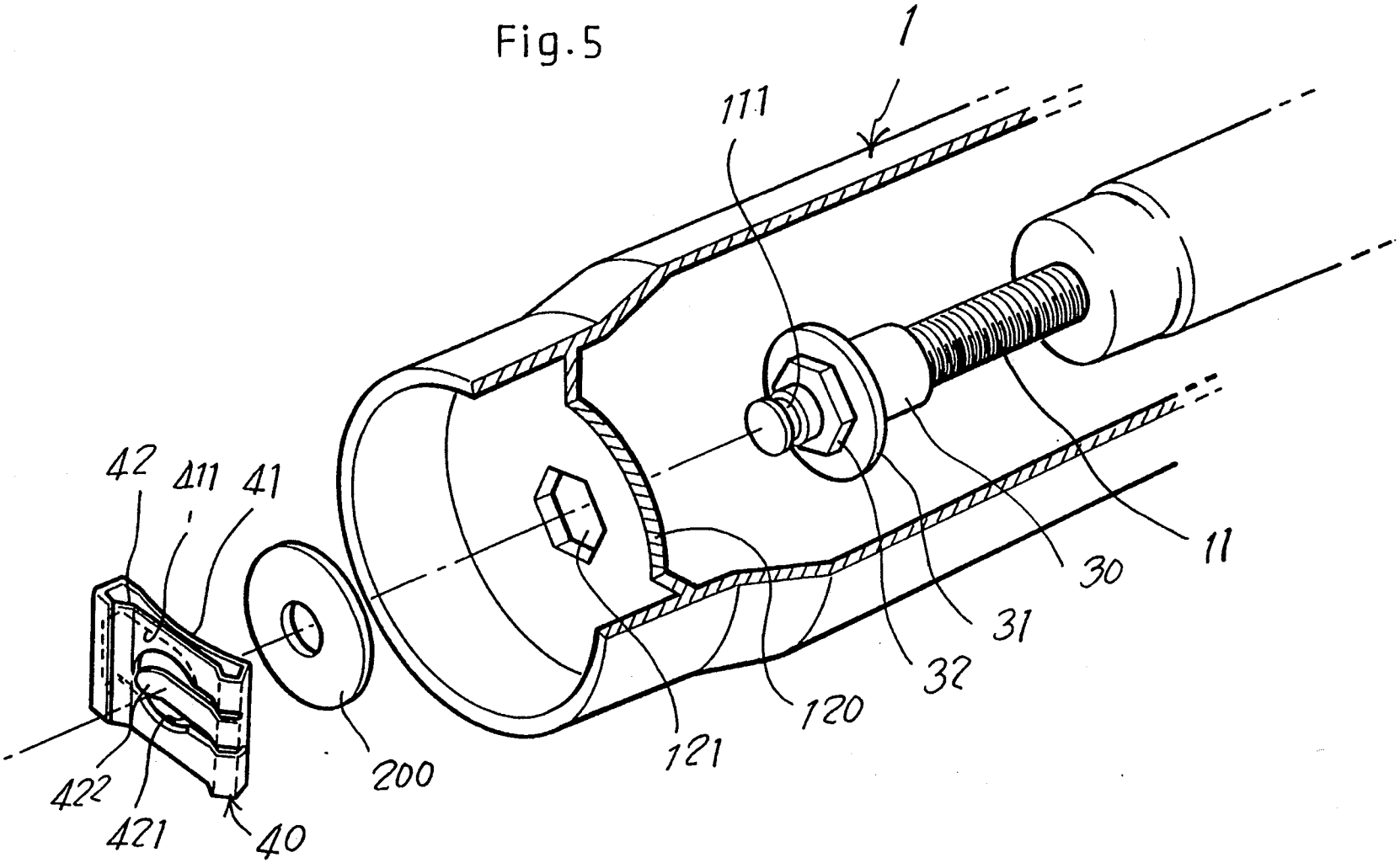
FIG. 5 is an exploded fragmentary perspective view of the screw shaft and the supporting pillar pipe applied to the height adjusting mechanism of the present invention.
Figure 6:
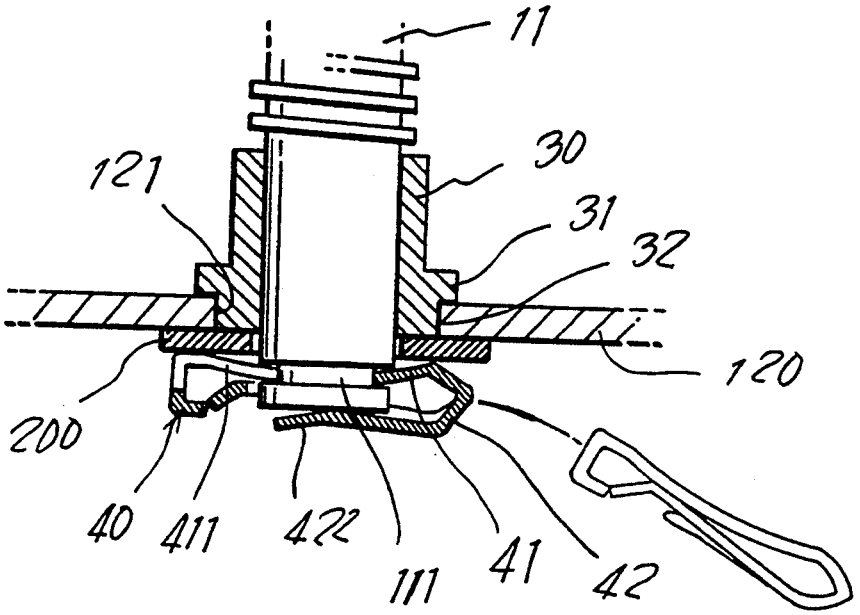
FIG. 6 is a fragmentary magnified cross sectional view of an essential portion showing a coupling structure of the screw shaft and the supporting pillar pipe of the present invention.

FIG. 5 and FIG. 6 show respectively each coupling structure of the screw shaft 11, and the screw shaft 11 is firmly fixed to a bottom surface of the supporting pillar pipe 1 such that any movement and rotation are impossible to a direction of shaft lengthwise and to a direction orthogonal to the shaft lengthwise direction. That is, a tightening force is provided by a flange type bush 30 which is separately manufactured and forcibly inserted by pressure and fixed to an end portion of the screw shaft 11, a polygonal opening 121 perforated in polygonal shape at a support plate 120 of the supporting pillar pipe 1, and a separate clip 40. In other word, the flange type bush 30 includes integrally a flange 31 having a rather larger diameter than a diameter of the polygonal opening 121 of the supporting pillar pipe 1 in a radial direction being orthogonal to the lengthwise direction of the bush body from the lower exterior wall of the bush and at the same time, includes integrally a holding portion 32 for preventing a rotation of the screw shaft by being coupled in an insertion fitting manner so as to be possible to freely fix and release which is made of same polygonal shape as the polygonal opening at immediately below the flange 31. At this moment, the flange 31 is placed on the support plate 120 of the supporting pillar pipe 1 whereby becomes to prevent that the screw shaft is dropped down to below the support plate 120. And, a clipping groove 111 is defined in a direction being orthogonal to a screw shaft's lengthwise direction at an external wall of an end portion of the screw shaft 11 exposed by passing through with the flange type bush 30, and a clip 40 is coupled to this clipping groove 111 in an insertion fitting manner so as to be possible to fix and release with the clip 40 and thereby the screw shaft 11 may be integrally fixed to the support plate 120 of the supporting pillar pipe 1. At this time, the clipping groove 111 is defined with a little distance from the bottom end of the flange type bush 30. That is, it is defined at a position identical with a length summed with a thickness of the support plate 120 of the supporting pillar pipe 1 and a thickness of the washer 200 from the flange 31, and when the clip 40 is inserted into the clipping groove 111, the screw shaft is firmly fixed and maintained so as of course not to move to up and down ward direction and not to rotate on the bottom surface of the supporting pillar pipe.

And, the clip 40 integrally includes a first holding surface 41 and a second holding surface 42 which are tightly confronting in a transverse direction against the screw shaft by bending a plate material of a small width in 'U'-shape, and it includes a first passing through hole 411 and a second passing through hole 421 having an inner diameter of a magnitude capable of freely fixing and releasing the end portion of the screw shaft 11 at each center of these first and second holding surfaces 41,42. At this time, the first holding surface 41 is made in a bent surface in cross section of the first holding surface so as to provide a bearing force confronting against the support plate 120 of the supporting pillar pipe 1, and the first passing through hole 411 defined at center of this first holding surface 41 may provide a clipping force by receiving a clipping groove 111 defined to the screw shaft 11. And, the second holding surface 42 includes a pressure-stopping piece 422 in which three sides in a direction of clip length are distanced away from the holding surface at a central portion and a side is integrally connected with the holding surface and thereby suppresses the clip which is going to be released from the screw shaft by pressing the end area portion of the screw shaft in case of fixing by inserting the clip to the screw shaft. This clip 40 may be manufactured via a pertinent pressing process by using an excellent metal plate material in resilient strength.

Now, it will be described in relation to the operation of mechanism of the chair with reference to the accompanying drawings FIGS. 2(A),(B) and FIG. 6. FIG. 2(A) is a longitudinal cross sectional view of a state that a person is not seated on the chair and in case when an occupier does not seat on the chair, the occupying load is not effected whereby the cylinder pipe 2 is lifted up by an expanding force of the second spring 52 and thereby the clutch plate 8 and the nut clutch 9 provided at the lower end portion of the cylinder pipe 2 are coupled together so that desired chair height adjusting operation is made. Explaining more in detail, as in a state on FIG. 2(A), when the clutch plate 8 and the nut clutch 9 are coupled together and the seating plate of the chair is rotated to right or left, the rotating force applied to the seating plate is transmitted to the clutch plate 8 through the cylinder pipe 2, and the rotating force transmitted to the clutch plate as this becomes to rotate the nut clutch being coupled by engaging with the clutch plate to its rotating direction. At this time, the nut clutch moves up or down along the screw shaft 11 which is assembled by a screwing method so that a desired height adjusting operation is made.

FIG. 2(B) shows a case of state that the occupied load is applied on the seating plate, and when the occupied load is applied on the seating plate, the cylinder pipe 2 drops down to downward. This dropping down makes the clutch plate 8 provided at the lower end of the cylinder pipe 2 to be separated from the nut clutch 9, and the occupied load transmitted through the cylinder pipe 2 is transmitted to the spring 52, the sleeve 6, and the roller seat 7 and thereby the occupied load is loaded on the nut clutch 9 so that the nut clutch becomes to set the seating position of the chair. At this moment, the spring 52 is contracted by the occupied load from a state that has been extended whereby executes a function of a space holding member between the washer 4 and the sleeve 6 and at the same time, directly transmits the occupied load to the nut clutch.

In this state, i.e., in a state that the occupied load is operated to the seating plate, the clutch operation is not effected even if the cylinder pipe is rotated, the cylinder pipe becomes only to rotate in idle, and when it is rotated in a state that an occupier is present, the height adjusting operation is not made. At this time, the occupied load is concentratively transmitted to the nut clutch 9 through the roller seat 7, and a mutual frictional force may be operated due to the occupied load between the thrust bearing and the nut clutch, and this frictional force transmits the rotational force applied to the cylinder pipe to the nut clutch whereby it is going to move the rut clutch, but the biting force of the rubber O-ring 12 contained within the chamber 92 of the nut clutch 9 operates a little bigger than the frictional force whereby the nut clutch is not easily moved by either the occupied load or an external force and it becomes to hold its adjusted position, therefore the height adjustment position is stably and firmly fixed and maintained.

And, since a braking force can be applied to the screw shaft by a simple construction containing the rubber O-ring within the nut clutch, relative to that previously a number of mechanical elements such as rubber ring and washer have been required on the surface of the nut fittings, there are advantages that parts numbers, manufacturing process and the processing numbers are decreased and thereby cost saving is obtained and productivity can be improved.

And, the power transmission for the height adjustment is connected or disconnected by the clutch function of the clutch plate 8 and the nut clutch 9 and at the same time, a vertical portion 931 and a slant portion 932 are provided within the recess 93 of the nut clutch 9, and a obtuse angled portion 933 is provided at a point where these are met together, and thereby in case when a load more than a predetermined value, that is, an abnormal exterior force further rotating the seating plate in a state that the nut clutch is reached a uppermost end of the screw shaft 11 due to a carelessness of a user, is operated, a sliding phenomenon is made to be occurred at the projecting portion 81 of the clutch plate 8 by the vertical and slant portions 931,932 which are provided within the recess 91 of the nut clutch 9, so that the nut clutch and the clutch plate are automatically separated, therefore, the tightening phenomenon of the nut clutch is completely prevented and accordingly not only a problem is excluded in which the nut clutch should be released back, but also a worry about a trouble or damage of the mechanical elements is completely prevented when a shock is transmitted to a joining portion of the column body upon releasing back the nut clutch, and hence there is effect that not only a quality of product is improved but also a using life is extended.

On the other hand, in the screw shaft 11, as shown in FIG. 6, when a clip 40 is inserted from the bottom to upward to an end portion of the screw shaft passed through the support plate 120 of the supporting pillar pipe 1 and then the first holding surface 41 of the clip 4 is aligned with the clipping groove 111 defined at the screw shaft, the clip is pushed in toward left at that state whereby an internal circumferential edge of the second passing through hole 411 defined at the first holding surface 41 is made to be inserted to a side of the clipping groove 111 of the screw shaft so that a clipping force is produced. At this moment, a bearing force corresponding to a direction to be opposite to the bottom surface of the supporting pillar pipe is operated by a bent surface of the first holding surface 41. This bearing force of the first holding surface produces a dropping force pulling down the screw shaft to a below of the bottom surface, on the contrary, the flange provided to the flange type bush 30 is abutted on the bottom of the supporting pillar pipe whereby a bearing force against the screw shaft being dropped down is operated so that the screw shaft is fixed on the bottom surface. And, since the holding portion of polygonal shape being integrally formed at below the flange 31 of the flange type bush 30 of the screw shaft 11 is coupled in an insertion fitting manner into the polygonal opening 121 of polygonal shape defined at the support plate 120 of the supporting pillar pipe 1 whereby the screw shaft being rotated in a direction orthogonal to the shaft lengthwise direction is prevented and thereby the screw shaft is made to be coupled and fixed in a simple insertion fitting manner within the supporting pillar pipe, in case of damage of the screw shaft or the supporting pillar pipe, partially and simply changing and repairing only the damaged parts are possible, accordingly a uneconomical and nonproductive defect that entire supporting pillar pipe should be changed heretofore is prevented and at the same time, there is advantage that the assembling is simple and easy whereby a productivity can be improved. Further more, since the assembling structure is simplified so as to be able to compatibly use respectively to a product of different kind, for instance, to a column of telescopic system or screw system, there is also an advantage that interchangeability is excellent.

Figure 7:
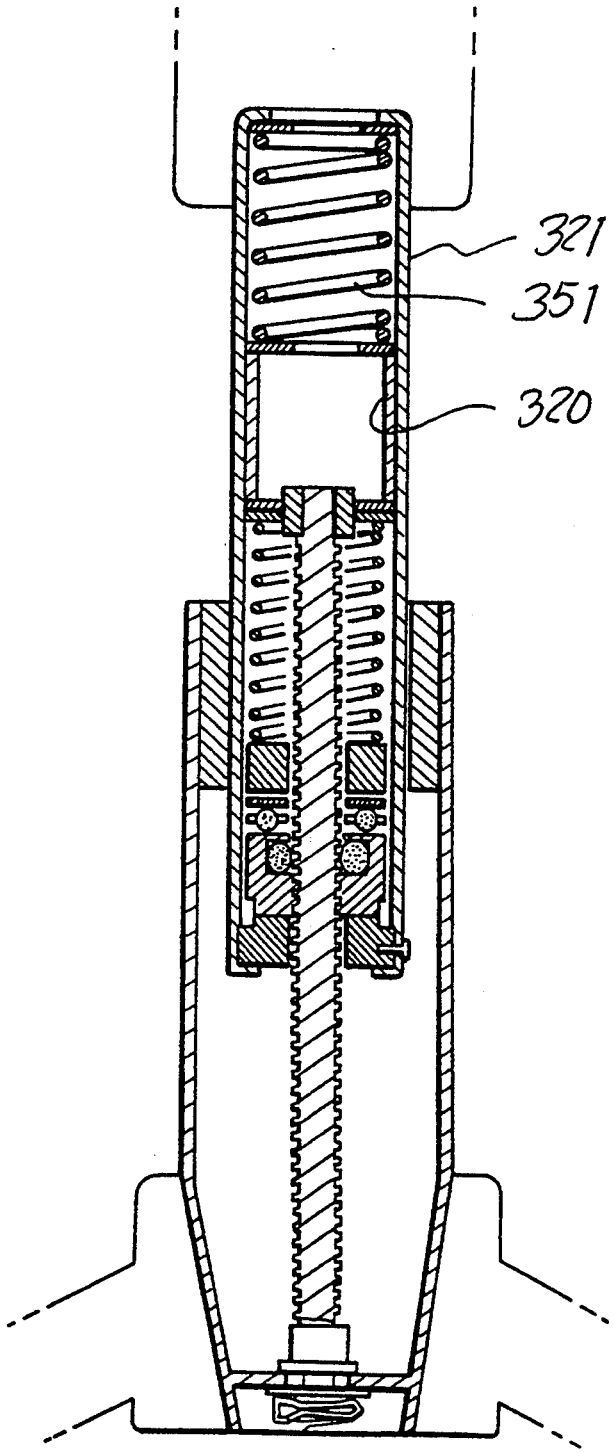
FIG. 7 is a longitudinal cross sectional view showing another embodiment of the present invention.

FIG. 7 shows another embodiment of the present invention, and in this embodiment, same part as in the above-described embodiment is depicted by adding "300" to the same reference numeral symbol. Difference between two embodiments is that in this embodiment an inserting portion 321 provided at top end portion of the cylinder pipe 302 among the column which bears the seating plate is structured in a straight tube form extending the outer diameter of the cylinder pipe 302 as it is without making to a taper form as the above-described embodiment and a first spring 351 is provided within this, and in this embodiment the seating plate may be placed by coupling in an insertion fitting manner to the inserting portion 321 provided at the top end portion of the cylinder pipe 302.

Up to now, it is described for the embodiments of the present invention, however, the present invention is not limited to these, and variations and modifications will be possible within a scope and spirit as described in the annexed claims.

What is claimed is:

1. A swivel chair comprising:

a support pillar pipe having a bottom surface;

a screw shaft connected to the bottom surface of the supporting pillar pipe;

a cylinder pipe for receiving the screw shaft, the cylinder pipe having arranged therein a first spring near an upper end of the cylinder pipe, a bushing below the first spring, a second spring below the bushing, a sleeve below the second spring, and a nut clutch below the sleeve;

a clutch plate located near a lower end of the cylinder pipe, the clutch pipe having projecting portions which cooperate with recesses formed in the nut clutch;

the supporting pillar pipe further comprising a supporting plate near the bottom surface thereof, the supporting plate having an opening therein for receiving and holding a bushing at a lower end of the screw shaft in a manner so as to prevent rotation of the screw shaft;

a clip for securing the lower end of the screw shaft, the screw shaft being provided with a clipping groove whereby the clip is connected to the screw shaft; and the recesses formed in the nut clutch having a wall comprising a vertical portion and a slanted portion.

2. A swivel chair as claimed in claim 1 wherein the opening is polygonal in shape, and the lower end of the screw shaft is also polygonal in shape.

3. A swivel chair as claimed in claim 2 wherein the opening and lower end of the screw shaft are hexagonal in shape.

4. A swivel chair as claimed in claim 1 wherein the slanted portion is about 3 times the length of the vertical portion.

5. A height adjusting mechanism for a swivel chair including a column having a supporting pillar pipe and a cylinder pipe telescopically coupled to each other and movable between an extended and a contracted position, the supporting pillar pipe and cylinder pipe being located between a leg and seating plate of the chair, the cylinder pipe having therein a bushing, a washer, a second spring and a roller seat, the cylinder pipe further including a clutch unit including recesses and projections movable relative to each other between a coupling position and a released position according to the load provided from the seating plate, a screw shaft being located in the supporting pillar pipe and the cylinder pipe and passing through the bushing, washer, spring, sleeve and roller seat within the cylinder pipe; and the recesses of the clutch unit have the vertical portions and slanted portions arranged so that the clutch unit is released allowing free rotation of the swivel chair when an exterior force above a predetermined amount is applied to the projection of the clutch unit.

6. A swivel chair as claimed in claim 5 further comprising a chamber within the clutch unit, the chamber including an O-ring so as to provide an engaging force of suitable pressure to the screw shaft to prevent the clutch from moving.

7. A swivel chair as claimed in claim 6 wherein the slanted portion has a gradient with an angle of between 40 and 50 degrees.

8. A swivel chair as claimed in claim 5 further comprising a flange at a bottom surface of the supporting pillar pipe, a holding portion on the flange of corresponding shape to a hole located in a bottom surface of the supporting pillar pipe, the flange and hole being coupled for free insertion but whereby rotation of the screw shaft is prevented, a clip being provided to engage a lower end of the screw shaft in a clipping groove thereof.

9. A swivel chair as claimed in claim 8 wherein the clip comprises first and second holding surfaces, first and second passing through holes for receiving an end portion of the screw shaft, and a pressing piece which presses an end of the screw shaft to prevent the clip form releasing the screw shaft.

10. A swivel chair as claimed in claim 5 further comprising an additional spring between the clutch unit and a top of the cylinder pipe.

* * * * *